United States Patent [19]

Ryan

[11] 4,151,871

[45] May 1, 1979

[54] EXTENDABLE RETRACTABLE INSULATIVE ENCLOSURE FOR A WINDOW AND THE LIKE OF A BUILDING

[76] Inventor: J. Michael Ryan, 2808 W. River Rd., Minneapolis, Minn. 55406

[21] Appl. No.: 908,378

[22] Filed: May 22, 1978

[51] Int. Cl.[2] ..... E06B 9/20; E06B 9/08

[52] U.S. Cl. ..... 160/25; 160/120

[58] Field of Search ..... 160/25, 120, 238, 239, 160/265

[56] References Cited

U.S. PATENT DOCUMENTS

| | | | |
|---|---|---|---|
| 1,255,817 | 2/1918 | Gibson et al. | 160/25 |
| 1,445,697 | 2/1923 | Love | 160/120 |
| 1,708,377 | 4/1929 | Cornell | 160/25 |
| 2,132,986 | 10/1938 | Julien | 160/265 |
| 2,311,348 | 2/1943 | Peters et al. | 160/239 |
| 2,341,123 | 2/1944 | Schweller | 160/25 |
| 2,856,995 | 10/1958 | Roth | 160/25 |
| 3,856,072 | 12/1974 | Sund | 160/238 |

*Primary Examiner*—Peter M. Caun
*Attorney, Agent, or Firm*—Wicks & Nemer

[57] ABSTRACT

An enclosure for a window or door having insulative extendable and retractable sheet members which includes a housing having insulated widewalls, an insulated bottom wall and an insulated top wall for securement to a building structure for encompassing a window or door with the enclosure. The enclosure includes an outer thin flexible sheet closure member mounted on a first spring-urged takeup roller mounted adjacent the top of said housing with the upper end connected to the first roller. Also included is an insulative sheet member including a first sheet member and a second sheet member spaced therefrom with insulative material mounted between the same. The insulative sheet member is connected at the upper end thereof to a second spring-urged roller mounted adjacent the first spring-urged roller. The lower ends of the outer thin flexible sheet closure member and the insulative sheet member are connected to a transverse bar with take-up and releasable flexible members connected to the transverse bar for raising and lowering the outer closure member and the insulative sheet member against the action of the spring-urged rollers. The side edges of the outer thin flexible sheet member and the side edges of the insulative sheet member operate in slots in the sidewalls of the housing for sealing engagement therewith.

6 Claims, 5 Drawing Figures

EXTENDABLE RETRACTABLE INSULATIVE ENCLOSURE FOR A WINDOW AND THE LIKE OF A BUILDING

SUMMARY

The impending shortage of energy needed to heat or cool building structures among other things has brought about a dire need for apparatus for conserving energy. The heat and cooling loss through the walls and particularly through and around the windows and doors of a building has been found to be very extensive in many cases and extremely wasteful.

With the above in mind, the invention relates broadly to an improvement in a device for insulation of a building structure and more particularly to a device which may be easily manipulated from a position of insulative enclosure upon an entire window or door to a storage position with which the entire window or door is exposed.

The device includes a housing which is secured to a building whereby the same encompasses a window or door. The housing has insulated sidewalls with a partial front wall defining an opening. Mounted in the housing is an outer closure sheet member which is mounted on a takeup roller at the top of the housing together with means at the edges of the sheet member for guiding the up and down movement of the sheet member, keeping the sheet member firm, and creating an insulation seal with the side members of the housing. The lower edge of the sheet member is secured to a transverse bar which makes sealing engagement with the bottom of the housing when the sheet member is lowered completely.

Further provided is an insulative closure sheet member which is mounted on a takeup roller adjacent the first mentioned roller and connected to the transverse bar and is raised and lowered with the closure sheet member. The insulative closure sheet member includes an outer and inner sheet between which is mounted loosely matted insulation material which allows compression upon the takeup roller for a very compact storage on the roller. The edges of the insulative closure sheet member have means at the edges for keeping the member firm and in sealing engagement with the side members of the housing through the opening of the housing.

The outer closure sheet member and the insulative closure sheet member constitute an insulative closure member which may be selectively raised to out of the way storage positions so as to fully expose the window or lowered to complete an insulated enclosure about the window.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
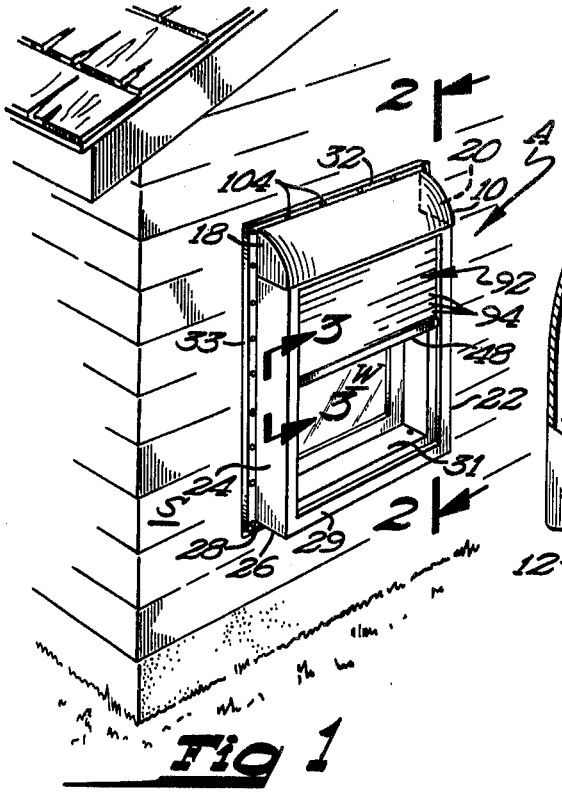
FIG. 1 is a perspective view of an enclosure for a window and embodying the invention with the closure member in partially raised position.

Referring to the drawings in detail, the enclosure A for the window W includes the arcuate top and partial front wall portion 10 which terminates at the lower edge in the interned flange 12 formed with the right angular flange 14 to which is secured the sealing gasket 16. Secured to the ends of the top portion 10 are the end members 18 and 20 and depending therefrom are the side members 22 and 24, respectively. The side members are made of rigid insulation board having a cellular structure such as "Bild-Rite" by the Boise Cascade Company and are connected at the lower ends by the rigid insulation bottom 26, and extending upwardly from the outer edge of the bottom 26 is the lower narrow partial front wall portion 29 which is connected to the side members 22 and 24. The wall 10 is also formed of rigid insulation. Secured to the front wall portion 29 and the structure S is the internal bottom 31. The bottom 26 has formed thereon the right angular flange **28*a* to which is secured the sealing gasket 34*a*. The upper edge of the top portion 10 is formed with the outwardly turned flange 32 to which is secured the sealing gasket 34. Each of the side members is formed with a flange 33 under which a gasket 33*a*** is positioned.

The side member 24 is formed on the inner surface thereof with the recess 35 which has formed in the bottom face thereof the longitudinally extending central slot 36 which terminates in the enlarged slot 38. The side member 24 is also formed with the outer slot 40 which terminates in the enlarged outer slot 42 spaced from the central slots. Further included is the inner slot 44 which terminates in the enlarged slot 46 spaced from the central slots. The side member 22 is formed identically to the side member 24, and both side members 22 and 24 are secured at the lower ends thereof to the inside of the bottom 26.

Figure 3:
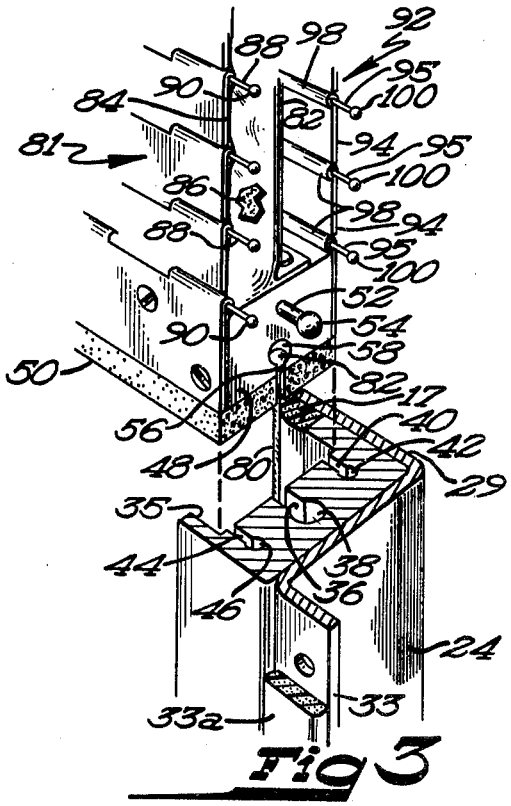
FIG. 3 is a partial sectional view on the line 3—3 of FIG. 1.
Figure 4:
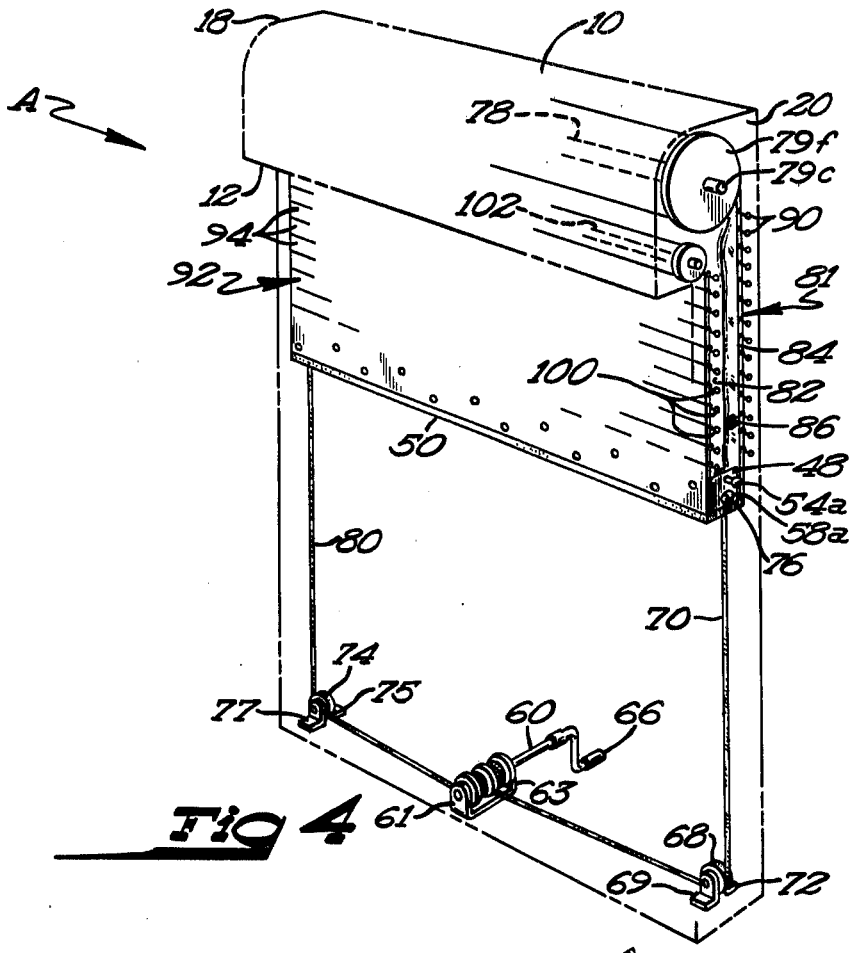
FIG. 4 is a perspective view of the enclosure with the housing thereof shown in phantom outline.

The numeral 48 designates a transverse support bar which has secured to the bottom thereof the gasket 50. On one end of the bar 48 is secured the short shaft 52 on the outer end of which is formed the ball end 54, particularly FIG. 3. An under portion of the end of the support bar 48 has formed therein the slot 56 which terminates in an enlarged hole 58, particularly FIG. 3. The other end of the bar 48 is formed with identical formations.

Further provided is the shaft 60 rotatably mounted in the spaced supports 61 and 63 secured to the bottom 26. The shaft 60 extends through a hole 62 extending through the wall W of a building structure S. The shaft 60 is formed with a square inner end portion 64 for engagement by a square socket in the crank 66 for rotation of the shaft. The numeral 68 deisgnates a first pulley mounted on the right angle supports 69 and 72 which are secured on the bottom 26. Also provided is a second pulley 74 mounted on the supports 75 and 77 secured to the bottom 26. A first flexible member 80 such as a cord or light cable has secured to one end thereof the ball 82 which is positioned in the hole 58 with the flexible member extended downwardly through the slot 56 and passed around the pulley 68 and secured to and wound around the shaft 60.

Figure 2:
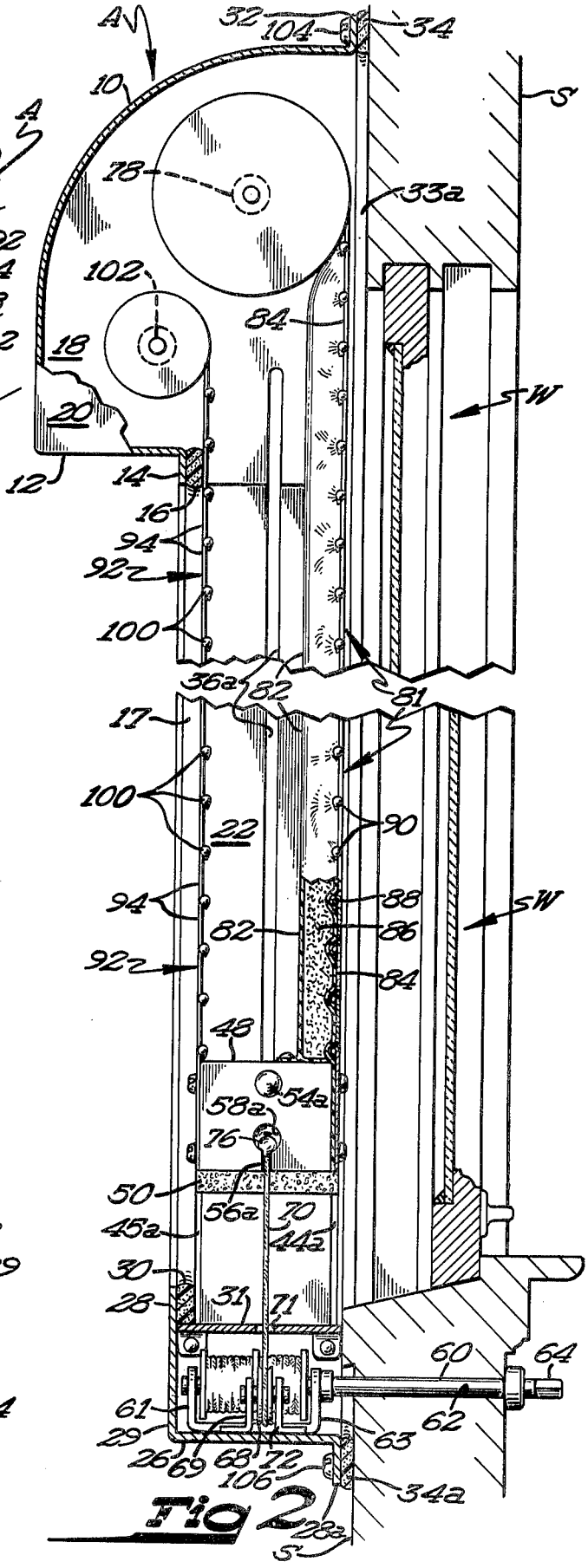
FIG. 2 is a sectional view on the line 2—2 of FIG. 1.

A second flexible cable 70 is also provided which is secured at one end to the shaft 60 and wound around the shaft in the opposite direction to that of flexible member 80 and passed around the pulley 68. The other end of the flexible member 70 has secured thereto the ball 76 which is positioned in the hole **58*a* with the flexible member 70 extended downwardly through the slot 56***a*, particularly FIG. 2. The cables 80 and 70 pass through in each instance a hole 71 formed in the inner bottom 31.

Figure 5:
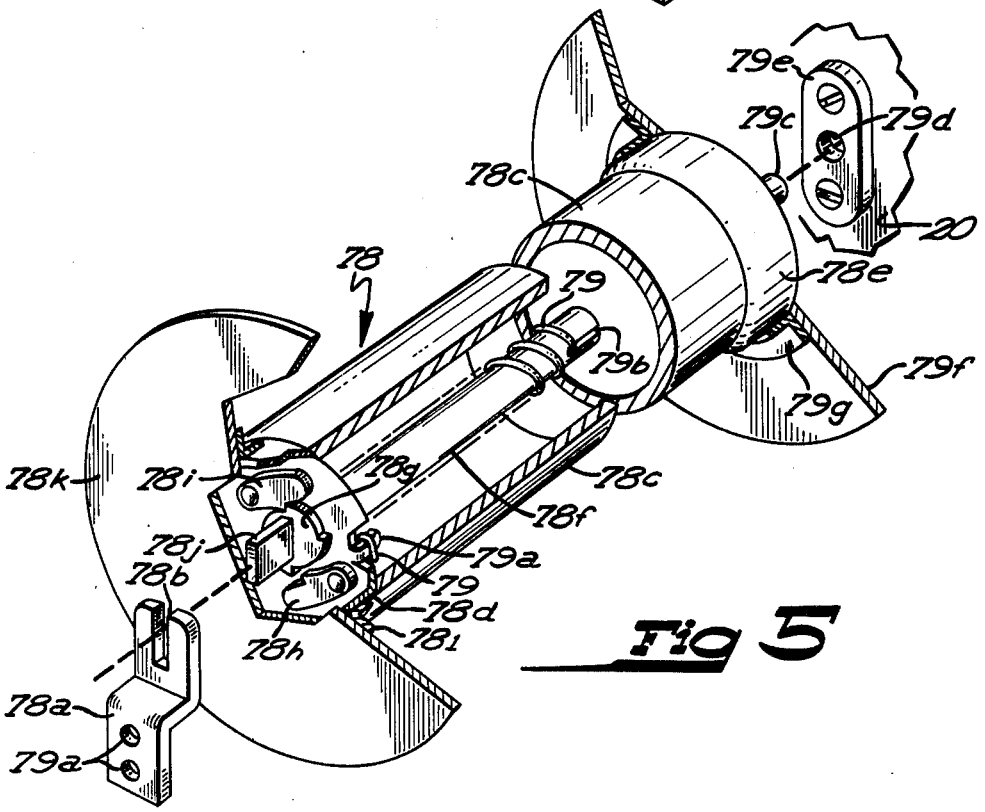
FIG. 5 is an exploded partial perspective of a spring urged takeup roller.

With particular reference to FIG. 5, the numeral 78 designates a storage roller mounted at one end in the bracket 78*a* having the slot 78*b* and secured to the inside surface of the end member 20 by means of a nut-equipped bolt extended through the end member 20 and the hole 79*a* of bracket 78*a* as hereinafter explained.

With further reference to FIG. 5, the roller 78 is a conventional roller such as that used in a conventional curtain shade which allows the pulling up and down of a sheet member with a setting at different positions and a release to allow the sheet member to travel freely upwardly. The roller 78 includes the tubular housing 78*c* secured at one end of the first cup-like end member 78*d* and at the other end to the second cup-like member 78*e*. Further included is the shaft 78*f* which is rotatably mounted at one end in the first end member 78*d*. Secured to the end of the shaft 78*f* at the end member 78*d* is the segmented cam 78*g* engageable by the pawls 78*h* and 78*i*.

Secured to the end of the shaft and the cam 78*g* is the key 78*j* which fits in the slot 78*b* of the bracket 78*a*. The numeral 78*k* designates a circular end plate for the roller 78 and is secured to the roller end member 78*d* by means of the brackets 78*l*. Further provided is the coil spring 79 axially mounted on the shaft 78*f* with one end secured to the lug 79*a* and the other end secured in the slot 79*b* formed in the end of the shaft 78*f*. The roller end member 78*e* includes a trunnion 79*c* which is rotatably mounted in the hole 79*d* of the bracket 79*e* which is mounted on the inside of the housing end member 18. Secured to the cup-like end member 78*e* is the circular end plate 79*f* by means of the circular bracket 79*g*.

An insulative closure sheet member 81 is provided which includes a first flexible sheet 82 of plastic or the like as part of the member 81 secured at the lower edge to the bar 48. Also provided is a second flexible sheet 84 as part of the member 81 secured at the lower edge to the bar 48 and spaced from the first sheet member 82. Mounted between the sheet members 82 and 84 is an insulative mat 86 formed of a soft cellular mat-like structure easily compressible such as fiberglass blanket insulation or polyurethane foam. The upper end of the sheet members 82, 84 and the mat 86 are secured to the roller 78. The opposed vertical edges of the sheet 84 have connected at each edge the short spaced extensions 88 on the ends of which are the ball end formations 90.

The extensions 88 slidably fit in the slots 44 with the ball ends 90 slidably fitting in the slot 46 whereby the insulative sheet member 81 together with the mat 86 and the sheet 84 are guided against displacement and in sealing engagement with the side member 24 as it is moved up and down as hereinafter described.

The number 92 designates an outer flexible thin closure sheet member of plastic or the like which may be made up of individual slats 94 connected together at the longitudinal edges by means of the conventional hinge formations 98 having the hinge pins 95 on the outer ends of which are formed the ball ends 100. The ball ends 100 engage in the slot 42. The lower edge of sheet 92 is secured to bar 48, and the upper edge secured to the storage roller 102 rotatably mounted in the ends 18 and 20. The roller 102 and the mounting thereof is identical to that of roller 78. The sheet member 92 is colored white on one side for reflection of the sun in the warmer months and the other side is of a dark color whereby the sheet member 92 may be reversed with the dark side presented outwardly during the colder months for absorption of heat from the sun.

The outer ends of the pins 95 extend slidably through the slots 40 with the ball ends 100 slidably mounted in the slot 42. Both edges of the member 92 are identically formed and cooperate identically with the side members 22 and 24. The ball 82 of flexible member 80 is mounted in hole 58 of bar 48 and the ball 76 of flexible member 70 is mounted in hole 58*a* of bar 48.

The enclosure A is mounted to encompass the window W on the building structure S by screw members 104 secured through the flange 32 and gasket 34 together with screw members 106 secured through the flange 28 and gasket 30. Screw members 108 are secured through the flanges 33 of side members 22 and 24 and into the building structure S.

OPERATION

The enclosure A is used as follows. Assuming the sheet members 92 and 81 are both wound fully upon the rollers 102 and 78, respectively, so that the window W is unobstructed. The members 92 and 81 are lowered by means of the crank 66 which is rotated whereby the cords 70 and 80 draw the crossbar and the sheet members connected thereto downwardly against the action of the springs in the rollers to a point where the gasket 60 makes sealing contact with the inner-bottom 31. As a result, the window is sealed off and substantially insulated from outside elements. In lowering the sheet members the same may be positioned at intermediate positions by stopping the crossbar at a given point and then allowing the cross bar to lift slightly so that the pawls 78*i* and 78*h* catch on the segmented cam 78*g* and hold the rollers and sheet members at a given position with or without the aid of the flexible members 70 and 80, if need be.

The sheet members may be raised and positioned at selected levels by unwinding the crank which allows the sheet members to raise to a level and then pulling down slightly whereby the pawls 78*i* and 78*h* engage the cam 78*g* and hold the roller, to secure the member again without the aid of the flexible members 70 and 80. As the insulation closure member is drawn up onto the rollers by means of the spring urged rollers, the mat 86 is easily compressed upon the roller 78 allowing compact storage thereof at the top of the unit. Conversely when the insulative closure member is lowered, the insulative mat 86 expands thereby substantially filling the space between the sheet members 82 and 84 to provide optimum insulation. The space between the sheet 92 and the sheet 82 provides a dead air space thereby adding to the insulative qualities of the unit.

Having thus described the invention, what is claimed as new and desired to be secured by Letters Patent is:

1. An extendable retractable insulative enclosure for a window and the like of a building structure comprising:

(a) a housing having sidewalls, a bottom wall and a top wall, (b) means for mounting said housing on a building structure to encompass a window, (c) an outer thin flexible sheet closure member, (d) a first spring-urged takeup roller mounted adjacent the top of said housing with the upper end of said outer closure member connected thereto, (e) an insulative sheet member including a first sheet member and (f) a second sheet member spaced therefrom with
(g) insulative material mounted between said first and second sheet members,
(h) a second spring-urged roller mounted adjacent the top of said housing with the upper ends of said first and second sheet members connected thereto,
(i) a transverse bar connected to the lower ends of said outer closure member and said first and second sheet members,
(j) means for lowering said transverse bar to thereby lower said outer closure member, said first and second sheet members and said insulative material against the spring action of said spring urged roller, said outer closure member, said first and second sheet members and said insulative material being raised by said spring-urged rollers to a wound up storage position on said rollers at the top of said enclosure and clear of the window when said lowering means is released,
(k) means for sealing the lower edge of said transverse bar with said housing,
(l) means for sealing and sliding engagement of the side edges of said outer closure member with the sidewalls of said housing, and
(m) means for sealing and sliding engagement of the side edges of said second sheet member with the sidewalls of said housing.

2. The device of claim 1 in which the walls of said housing include insulative material.

3. The device of claim 1 in which the means for sealing the lower edge of the transverse bar with said housing includes an internal bottom against which the transverse bar is contacted.

4. The device of claim 3 in which said means for sealing and sliding engagement of the side edges of said outer closure member with the sidewalls of the housing includes
(a) each of said sidewalls has a slot formed therein, and
(b) extension means carried by each edge of said outer sheet closure member for sliding and sealing engagement within said slots.

5. The device of claim 1 in which said means for sealing and sliding engagement of the side edges of said second sheet member with the sidewalls of said housing includes
(a) a slot formed in each of said sidewalls, and
(b) extension means carried by each side edge of said second sheet member for sliding and sealing engagement within said slots.

6. The device of claim 1 in which said means for lowering said transverse bar, the outer closure member and said first and second sheet members together with the insulative material and connected to said transverse bar includes
(a) a shaft carried by said housing,
(b) a first flexible member connected to said transverse bar at one end thereof and said shaft,
(c) a second flexible member connected to said transverse bar at the other end thereof and said shaft, and
(d) means for rotating said shaft to wind up said flexible members on said shaft to thereby lower the transverse bar, the outer closure member, the first and second flexible mbmers and insulative material carried by said transverse bar.

* * * * *